US007467579B1

(12) United States Patent
Portmann

(10) Patent No.: US 7,467,579 B1
(45) Date of Patent: Dec. 23, 2008

(54) MINE CLEARING DEVICE INCORPORATING PNEUMATIC THRUST AND UNBIASED MOTION

(75) Inventor: Helmut Portmann, Panama City, FL (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 332 days.

(21) Appl. No.: 11/254,117

(22) Filed: Oct. 17, 2005

(51) Int. Cl.
*F41H 11/12* (2006.01)

(52) U.S. Cl. ..... 89/1.13; 102/403

(58) Field of Classification Search ..... 89/1.13; 102/402, 403

See application file for complete search history.

(56) References Cited

U.S. PATENT DOCUMENTS 3,647,012 A * 3/1972 Mackerle ..... 180/8.7
5,038,866 A * 8/1991 Kern et al. ..... 169/28
6,378,634 B1 * 4/2002 Yim ..... 180/7.1

* cited by examiner

*Primary Examiner*—Stephen M Johnson
(74) *Attorney, Agent, or Firm*—James T. Shepherd

(57) ABSTRACT

A mine clearing device has an outer body forming a cavity capable of holding a pressurized substance, a conduit in the outer surface for expelling the pressurized substance from the body to thereby cause the device to rotate and traverse a mine field, and a plurality of anti-axial projections on the surface of the outer body that interact with the terrain to impart unbiased motion to the body as it rotates. A regulator controls the flow of the substance and a nozzle directs it as it exits the conduit. The outer body is made of blast resistant material. A shock absorbent material, disposed within the shell, absorbs the explosive force of mines. Circuitry or a marker substance may be used to record the position of the device.

16 Claims, 4 Drawing Sheets

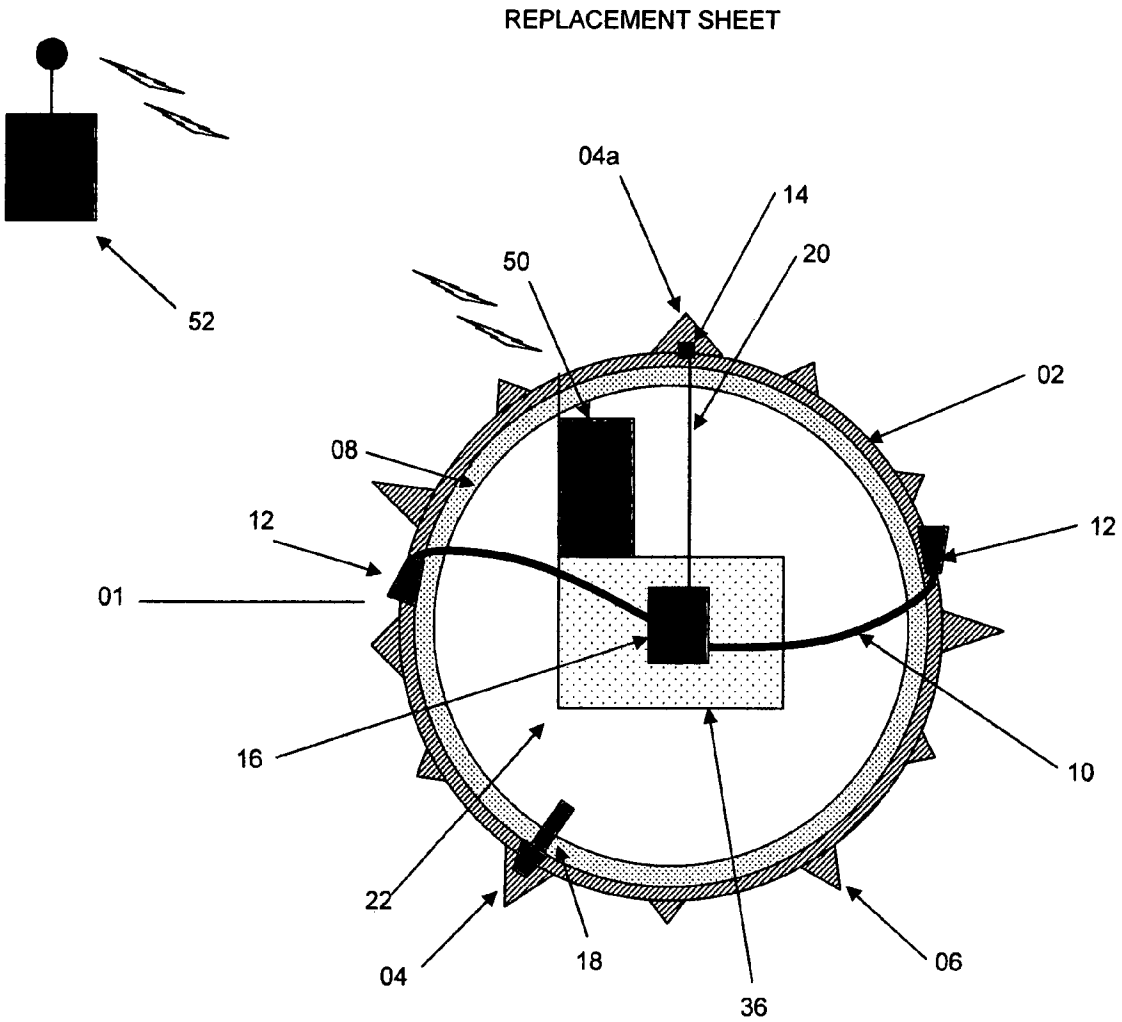
FIG. 3
REPLACEMENT SHEET

MINE CLEARING DEVICE INCORPORATING PNEUMATIC THRUST AND UNBIASED MOTION

STATEMENT REGARDING FEDERALLY SPONSORED RESEARCH OR DEVELOPMENT

The invention claimed and disclosed herein may be manufactured and used by, or on behalf of, the Government of the United States of America for government purposes without the payment of any royalties thereon or therefor.

BACKGROUND OF THE INVENTION

The present invention relates generally to mine clearing devices incorporating unbiased motion, more particularly to a mine clearing device comprising a blast-resistant body and having a plurality of projections to impart unbiased motion to the device.

There are, currently, millions of land mines remaining on the ground from past wars and scattered around dozens of countries, most of which are poor, undeveloped countries with limited resources. Most of these mines are anti-personnel mines that maim rather than kill their victims. It has recently been estimated that over seventy people, mostly civilians, are injured by mines every day and that over five million new mines are manufactured and laid each year with very little expense. Detection and clearing of these mines is a difficult problem. The most common techniques include either walking through an area with a metal detector or slowly and laboriously probing the ground manually to physically feel a buried mine, hopefully without detonating it. Unfortunately, these methods are extremely time-consuming and dangerous to the personnel involved. What is needed is a simple, safe and inexpensive system to find and detonate mines in a manner that can be mass produced and distributed in very large numbers and that can be easily used by uneducated and unsophisticated users with minimal logistical support or resources.

Recent technology solutions have focused on the increasing use of unmanned systems to locate and detonate land mines. Also, previously known mine clearing devices include devices that are attached to vehicles and set off mines and absorb the blast as the vehicle travels through the minefield. However, these devices, although effective at clearing mines, are too expensive, too complex, and too cumbersome to deploy affordably in effective numbers throughout the world.

BRIEF SUMMARY OF THE INVENTION

Accordingly, an object of an embodiment of the present invention is to provide an apparatus for clearing mines which is inexpensive and easy to operate.

Another object of an embodiment of the present invention is to provide an easy to use mine clearing device that can be used by persons, organizations, or countries with limited resources.

A still further object of an embodiment of the present invention is to provide an apparatus for clearing mines that may be operated in areas where limited resources are available wherein the mine clearing device only requires pressurized air to operate.

Another object of an embodiment of the present invention is to provide a more cost effective and simple means of marking areas traversed by the device.

Other objects and advantages of the present invention will become more obvious hereinafter in the specification and drawings.

In accordance with the present invention, a device for clearing mines comprises a body having a continuous outer surface that forms a cavity suitable for containing a pressurized substance, a plurality of projections anti-axially disposed on the outer surface and adapted to interact with the terrain to impart unbiased motion to the body, and at least one conduit formed within the outer surface and communicating with the cavity and adapted for expelling the pressurized substance from within the cavity and tangentially from the outer surface to thereby impart rotational motion to the body. Preferably, the body of the device is composed of blast resistant material.

Also preferably, a tube is formed through the outer surface and adapted for recharging said pressurized substance into said cavity. A regulator is disposed within the cavity, proximate to and operable with the conduit to regulate the expulsion of the pressurized substance through the conduit to thereby impart motion to the device. At least one nozzle is disposed on the outer surface of the body and operable with the conduit to optimally direct the expulsion of the pressurized substance from the cavity. A control is disposed on the outer surface of the device and is coupled to the regulator to activate the expulsion of the substance from the cavity.

In accord with one embodiment of the present invention, the mine clearing device further includes a shock absorbent material having a substantially continuous surface disposed in substantial contact with an inner surface of the shell and adapted for absorbing the shock of the explosive forces upon the outer surface of the shell.

In another embodiment of the present invention, the cavity further contains a marker substance that may be expelled along with the pressurized substance to mark the areas on the terrain traversed by the device.

In yet another embodiment of the present invention, circuitry is disposed substantially within the cavity and operable for tracking the path traveled by the device. Preferably, the circuitry transmits position data to a remote receiver.

Also in accordance with the present invention, a method for clearing mines is provided, comprising the steps of charging the interior of a substantially hollow body with a pressurized substance, the body having a plurality of anti-axially disposed projections on its outer surface; placing the body in an area to be cleared of mines; activating a regulator within the body to allow the pressurized substance to be expelled from the body's outer surface, thereby imparting rotational movement to the body and causing it to traverse the area to be cleared of mines; exploding a mine by contacting the body with the mine; dispersing the blast energy from the mine's explosion that was imparted to the body by converting the blast energy to kinetic energy; and randomly traversing the body across the area to be cleared of mines, the body being propelled by the kinetic energy in combination with the rotational movement of the body.

Preferably, the outer surface of the body is adapted to resist the blast energy. Also preferably, the step of activating the regulator is accomplished by a control mounted on the outer surface of the body.

In one embodiment of the present invention, circuitry is installed inside the body to detect and transmit its location. In another embodiment, the area traversed by the body is marked by using a marker substance that is expelled from the body along with the pressurized substance.

Accordingly, the preferred embodiment of the present invention is directed to an apparatus and process that satisfies the need for a mine clearing device that is inexpensive, easy to operate, effective and safe. The present invention is further directed to an apparatus and method which combines the simple and reliable technology of an unbiased moving, autonomous, pneumatically powered body with an outer surface which will resist the explosive force of mines, and a plurality of projections on the outer shell for imparting unbiased motion, therefore providing a simple, inexpensive, but effective mine clearing device.

BRIEF DESCRIPTION OF THE DRAWINGS

Other objects, features and advantages of the present invention will become apparent upon reference to the following description of the preferred embodiments and to the drawing, wherein corresponding reference characters indicate corresponding parts of the drawing and wherein:

FIG. 3 shows a cross-section view of the apparatus for mine clearing, which incorporates a pneumatic system to impart motion in accordance with an embodiment of the present invention.

DETAILED DESCRIPTION

Figure 1:
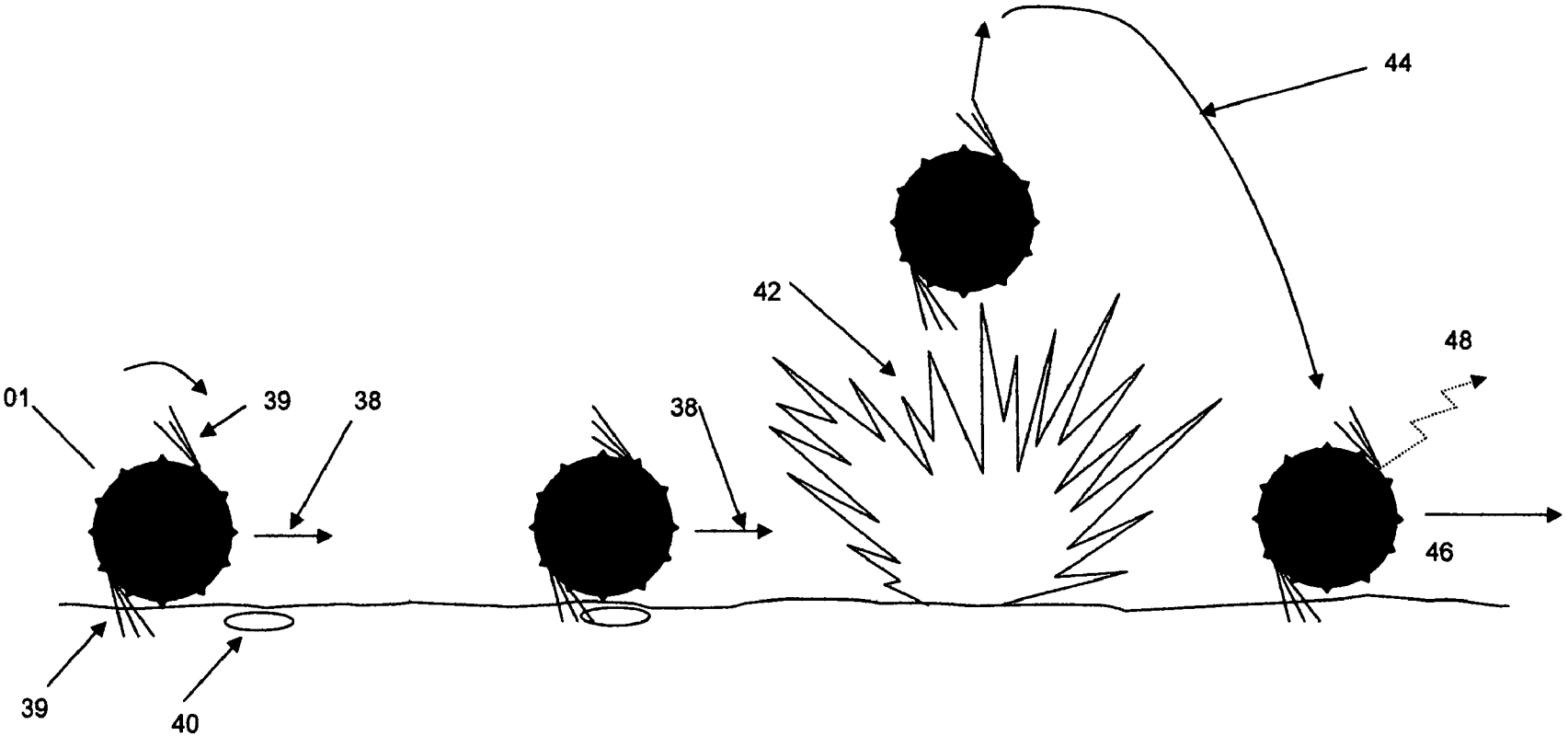
FIG. 1 illustrates a process for using the mine clearing device in accordance with an embodiment of the present invention.

As shown in FIG. 1, the preferred embodiment of this invention comprises a mine clearing device 01 that operates by traversing a minefield (shown as step 38), encountering mines 40, exploding the mines (step 42), resisting the blast of such mines and dispersing the kinetic energy (step 44), and then continuing to traverse the minefield (step 46).

As shown in FIG. 3, mine clearing device 01 comprises a shell 02 forming a cavity 22 capable of holding a pressurized substance (not shown). A plurality of anti-axial projections 04 and 06 extend from the surface of shell 02 (also shown in FIG. 2). Conduits 10 pass from the cavity 22 through the outer surface of shell 02. Regulator 16 is mounted inside cavity 22 and controls the rate of release of the pressurized substance through the conduits 10. A nozzle 12 is embedded substantially within shell 02 at the end of each conduit 10. Nozzle 12 optimally directs the release of the pressurized substance, preferably in a direction substantially tangential to the outer surface of shell 02. The rotational force imparted to mine clearing device 01 by the release of the pressurized substance expelled from cavity 22 through conduit 10 and nozzle 12, in conjunction with the interaction of projections 04 and 06 with the terrain, imparts unbiased motion to mine clearing device 01.

A shock absorbent material 08 is contained within, and is contiguous to, the inner surface of shell 02. Shock absorbent material 08 helps to absorb the shock from the explosion of mines that the mine clearing device 01 encounters. Mine clearing device 01 includes a control 14 for activating the device and a tube 18 for recharging cavity 22 with the pressurized substance. A marking substance (not shown) may be contained in cavity 22 in communication with regulator 16, where it can be passed to the conduits 10 for marking areas traversed by mine clearing device 01.

In the preferred embodiment of the present invention, shell 02 is composed of a blast resistant material capable of resisting the explosive force of mines. The material may be composed of any suitable species of hard plastic, such as ABS (Acrylonitrile Butadiene Styrene), or may be composed of other similar blast resistant materials known to those skilled in the art. Cavity 22 is formed within shell 02 and holds a pressurized substance such as air. Shell 02 may serve as a pressure vessel capable of holding the pressurized substance. In that case, Shell 02 may be constructed of, e.g., a carbon fiber pressure skin covered by an ABS blast resistant outer layer. Alternatively, tanks or plenums (not shown) capable of holding pressurized air or gas may be placed within cavity 22. Shell 02 may be molded (shaped) to optimally hold and position the tanks, or the tanks may be fastened in place within cavity 22 by any mechanical fastener means known to those skilled in the art.

In reference to FIG. 3, regulator 16 is mounted in a fixed position inside cavity 22. Regulator 16 can be any electrical or mechanical regulator known to those skilled in the art as being suitable for controlling the release of a pressurized substance from a tank or other container. Conduits 10 extend from regulator 16 and pass through the outer surface of shell 02 to expel the pressurized substance to the outside. In the preferred embodiment of the present invention, at least two axially disposed conduits 10 are used. Each conduit 10 preferably has a nozzle 12 disposed at its end where it exits shell 02. Nozzle 12 directs the expulsion of the pressurized substance tangentially away from the outer surface of shell 02, thereby imparting rotational motion to mine clearing device 01. Nozzle 12 may be any mechanical nozzle suitable for directing the flow of a released pressurized substance known to those skilled in the art.

In the preferred embodiment of the present invention, conduits 10 are tubes similar to those used in SCUBA devices, or any other tubes known to those skilled in the art. Conduit 10 may be affixed to the inner surface of shell 02 with clamps or any other mechanical fastener known to those skilled in the art. Alternatively, conduit 10 may be held in place by glue or the shock absorbing foam injected into shell 02 as discussed below.

Shock absorbent material 08 is adapted for absorbing the shock of exploding mines. Preferably shock absorbent material 08 is made of any foam material, polyethylene or other substance or material which may be injected into shell 02 in order to coat the interior surface of the shell, or fill unused space if tanks or plenums are used as discussed previously. By filling the unused space in shell 02, the interior components will be fixed in place thereby insulating them from shock when the mine clearing device encounters a mine. Alternatively, layers of foam may be glued or otherwise adhered to the interior components, including regulator 16 and conduits 10. Suitable shock absorbent material may include any foam currently known to those skilled in the art capable of absorbing explosive shocks.

Figure 2:
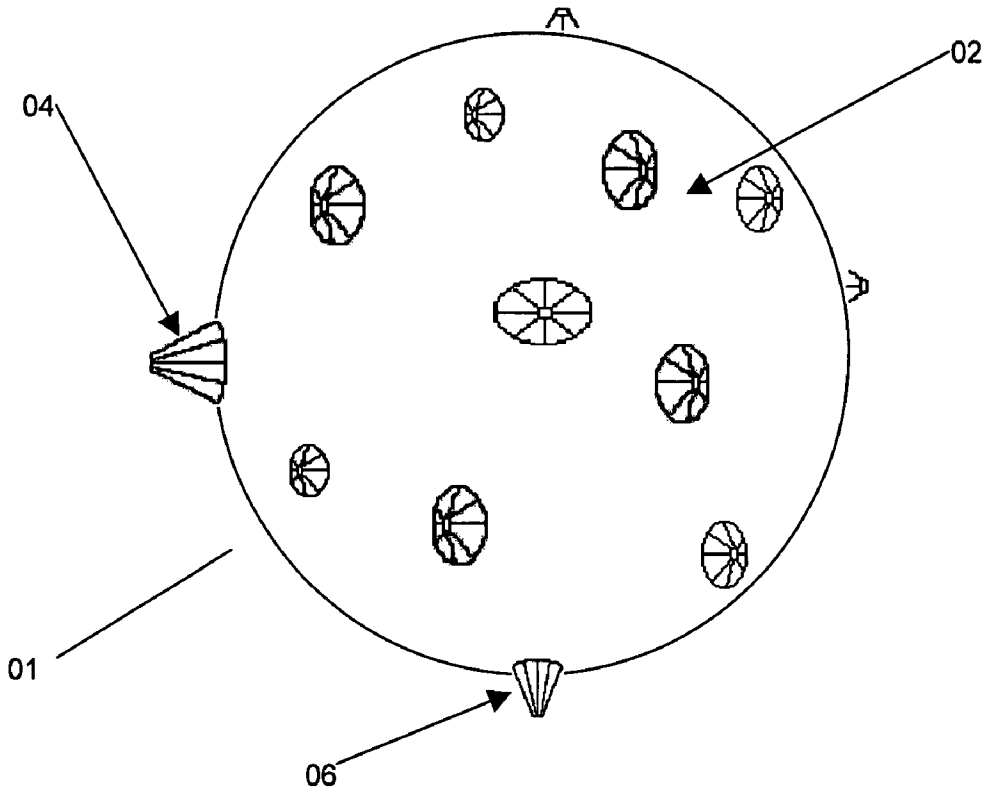
FIG. 2 shows a perspective view of the apparatus for mine clearing in accordance with an embodiment of the present invention.

Referring to FIG. 2, projections 04 and 06 are disposed anti-axial to each other on the outer surface of shell 02. Projections 04 and 06 are of varying sizes and are irregularly spaced to facilitate unbiased motion of mine clearing device 01 as it rolls across terrain under the rotational motion provided by the expelled pressurized substance. The exact size and positioning of the projections 04 and 06 is dependent on the size of mine clearing device 01 and the randomness of motion desired, and can easily be selected with minimal experimentation.

FIG. 3 also illustrates control 14 mounted on the outer surface of shell 02, enabling the user to activate and deactivate mine clearing device 01. A connector 20 couples control 14 to regulator 16. Control 14 may comprise any known mechanical switch that operates to activate and deactivate regulator 16, or alternatively may comprise any electro-mechanical dial or equivalent device that enables selection of varying pressure levels or flow rates of the pressurized substance passing through the regulator. Preferably, control 14, is located under the base of one of the projections (shown as item 04*a* in FIG. 3) on the outer surface of shell 02. Projection 04*a*, covering control 14, provides structural protection to control 14 and shields it from exploding mines. Projection 04*a* may be hinged with a locking mechanism so that the projection may be swung open to provide access to control 14.

A tube 18 adapted for replenishing the pressurized substance to cavity 22 extends through the outer surface of shell 02 to cavity 22. For example, tube 18 could be similar to a valve stem found on an automobile tire, with a fitting on its exterior end to accept a standard air pump supply line. Preferably, tube 18 is protected by a projection 04 in the same manner as described previously for control 14.

In continued reference to FIG. 3, an embodiment of the present invention includes means for recording or marking areas that mine clearing device 01 has traversed. Recording or marking allows a user to ensure that an area has been cleared of mines. Accordingly, cavity 22 may contain a marker substance that may be expelled with the pressurized substance through conduit 10 and nozzle 12, via regulator 16, to thereby mark the areas traversed by mine clearing device 01 on the terrain. The marker substance may be composed of powdered chalk, paint or any other similar substances known to those skilled in the art suitable to mark terrain. The marker substance may be freely mixed with the pressurized substance before or after cavity 22 is filled with the substance, or it may be contained in a separate marker container 36 within cavity 22. If the marker substance is contained in a separate marker container 36, the marker container 36 will be coupled to regulator 16, which will be configured to control the rate at which the marker substance is expelled. A separate marker fill tube (not shown) will extend from the outer surface of shell 02 to the marker container 36.

Alternatively, circuitry 50 may replace or be included with marker substance 36 to track areas traversed by mine clearing device 01. The circuitry may include Global Positioning System (GPS) circuitry and/or data-recording and data transmission devices known to those skilled in the art. Additionally, such circuitry may include an accelerometer to measure acceleration of mine clearing device 01 as it traverses terrain. Acceleration data may be recorded by the circuitry and transmitted to a remotely located user 52 to provide useful information on the mine clearing device's 01 location and status. For example, when the acceleration of mine clearing device 01 spikes high, it has likely encountered a mine.

Figure 4:
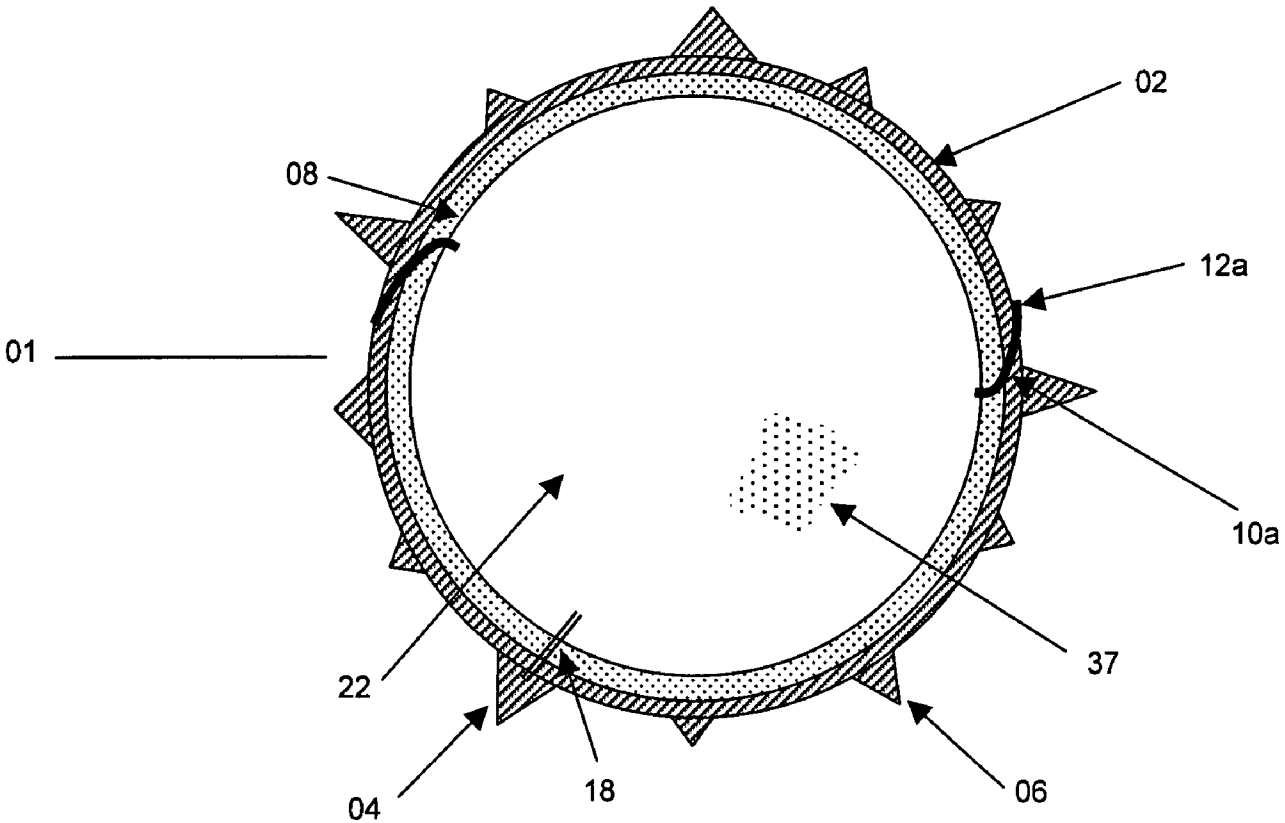
FIG. 4 shows a cross-section view of an alternative embodiment of the apparatus for mine clearing.

FIG. 4. shows a cross-section of an alternative embodiment of the present invention. In this embodiment of the present invention, nozzles 12*a* are configured to regulate the rate of flow of the pressurized substance, thereby eliminating the need for a regulator, regulator control and long conduits extending from the regulator to the outer shell. Nozzles 12*a* may be of a type well known to those skilled in pneumatics that can be configured to be opened or closed as necessary to allow for selectively adjusting the flow of the pressurized substance. Short conduits 10*a* will extend from nozzles 12*a* through shell 02 and blast absorbent material 08 to communicate with cavity 22 and the pressurized substance contained therein. This embodiment maximizes the capacity of the pressurized substance that can be stored in cavity 22 by eliminating the internal components. Marker substance 37 is injected directly into cavity 22 via nozzle 18 along with the pressurized substance.

FIG. 1 illustrates how an embodiment of the present invention is used. Preferably, the user first fills cavity 22 with pressurized air and a marking substance through tube 18 from a tank of pressurized air or other appropriate gas known to those skilled in the art. The user then places or propels mine clearing device 01 into the area to be cleared of mines. The user activates mine clearing device 01 by control 14. Mine clearing device 01 then autonomously traverses the terrain in random directions (shown as step 38 in FIG. 4). The pressurized substance expelled from nozzles 12 through conduits 10 (step 39) imparts rotational motion to mine clearing device 01 and projections 04 and 06 cause the device to travel in a random, unbiased manner. When mine clearing device 01 physically encounters a mine 40, the mine will explode (step 42). Shell 02 resists the explosion from the mine and shock absorbent material 08 absorbs some of the explosive shock. The energy from the explosion will be dispersed as kinetic energy, causing mine clearing device 01 to be launched (step 44). Mine clearing device 01 then lands and continues to traverse the minefield (step 46), encountering and exploding mines until the minefield is cleared. During this process, the marking substance will be released, marking areas that the device 01 has traversed. An alternative embodiment of the present invention may further involve transmitting location and/or acceleration data to a remote user (step 48). When all areas of the minefield have been traversed and marked, the area is clear of mines. The user may then recover mine clearing device 01.

The preferred method for clearing mines uses multiple mine clearing devices 01 simultaneously to clear the selected terrain of mines in a shorter period of time. Further, the area to be cleared may be cordoned off (not illustrated) by the user at a height that will prevent mine clearing device 01 from escaping the area to be cleared. Mine clearing device 01 will continue to traverse the minefield in an unbiased route until it encounters the cordons or other barriers that enclose the area to be cleared. It will then rebound off of the cordon and continue to traverse the enclosed area. By using cordons, the user may thereby confine mine clearing device 01 to a particular area, facilitating the expedient clearing of mines from the cordoned area.

The present invention thusly provides a solution to the need for an inexpensive mine clearing device for users having few fiscal and material resources at hand. Further, the present invention provides a convenient method to record the areas that have been cleared by use of a marking substance or circuitry. It may be used alone or in multiples to safely and conveniently clear mines from a minefield. Further, the present invention requires no vehicle to use it, thereby reducing its operational expenses. Since the present invention operates autonomously and remotely, the explosive force of mines does not pose a risk of harm to personnel.

In this disclosure, there is shown and described only the preferred embodiment of the invention as well as some alternatives. However, it is to be understood that the invention is capable of use in various other combinations and environments and is capable of changes or modifications within the scope of the inventive concept expressed herein. Unless expressly stated otherwise, all the features described in this disclosure (including the accompanying claims, abstract and drawings) may be replaced by alternative features serving the same, equivalent or similar purpose. Thus, unless expressly stated otherwise, each feature disclosed is but an example of a generic species of equivalent or similar features.

I claim:

1. A device for clearing mines, comprising:

a shell having a continuous outer surface and an inner surface that forms a cavity suitable for containing a pressurized substance;

a plurality of projections anti-axially disposed on the outer surface of said shell and adapted to interact with the terrain to impart unbiased motion to said shell; and at least one conduit formed within said outer surface and communicating with said cavity and adapted for expelling said pressurized substance from within said cavity and substantially tangentially from said outer surface to thereby impart motion to said shell.

2. The mine clearing device of claim 1, wherein at least one of said plurality of projections is of a different length than at least another one of said plurality of projections.

3. The mine clearing device of claim 1, wherein said plurality of projections are spaced irregularly around said outer surface.

4. The mine clearing device of claim 1, wherein said shell comprises a blast resistant material.

5. The mine clearing device of claim 1, further comprising a regulator disposed within said cavity, coupled to said conduit, and operable with said conduit to regulate expulsion of said pressurized substance through said conduit.

6. The mine clearing device of claim 1, further comprising a nozzle disposed on said outer surface of said shell and operable with said conduit to optimally direct the expulsion of the substance from said cavity through said conduit.

7. The mine clearing device of claim 5, further comprising a control disposed on said outer surface of said shell and operable with said regulator to activate the expulsion of said substance from said cavity and through said regulator and said conduit.

8. The mine clearing device of claim 1, further comprising a shock absorbent material having a substantially continuous surface disposed in substantial contact with said inner surface of said shell.

9. The mine clearing device of claim 1, wherein said cavity further contains a marker substance suitable to mark the areas of terrain traversed by said shell and that may be expelled with said pressurized substance.

10. The mine clearing device of claim 1, further comprising circuitry disposed substantially within said cavity and operable for tracking the path traveled by said shell and transmitting position data to a remote receiver.

11. The mine clearing device of claim 1, further comprising circuitry disposed substantially within said cavity and operable for recording the accelerations of said shell and transmitting acceleration data to a remote receiver.

12. The mine clearing device of claim 1, further comprising a tube formed through said outer surface of said shell and adapted for recharging said pressurized substance into said cavity.

13. A method for clearing mines, comprising:

charging the interior of a substantially hollow body with a pressurized substance, said body having an outer surface and a plurality of anti-axially disposed projections on said outer surface;

placing said body in an area to be cleared of mines;

activating a regulator to allow said pressurized substance to be expelled substantially tangentially from said outer surface, thereby imparting rotational movement to said body and causing said body to traverse said area to be cleared of mines;

exploding a mine by contacting said body with the mine;

dispersing the blast energy that was imparted to said outer surface from said mine's explosion by converting the blast energy to kinetic energy; and randomly traversing said body across said area to be cleared of mines, said body propelled by said kinetic energy in combination with said rotational movement of said body.

14. The method of claim 13 further comprising the steps of placing a marker substance within said body and marking the area traversed by said body by expelling said marker substance from said body when said body is traversing said area to be cleared of mines.

15. The method of claim 13 further comprising the steps of installing circuitry inside said body to detect and transmit the location of said body, and receiving at a remote location position data from said circuitry when said body is traversing said area to be cleared of mines.

16. The method of claim 13 further comprising the steps of installing circuitry inside said body to measure and transmit the acceleration of said body, and receiving at a remote location acceleration data from said circuitry when said body is traversing said area to be cleared of mines.

* * * * *